US009027164B2

(12) United States Patent
Seiler

(10) Patent No.: US 9,027,164 B2
(45) Date of Patent: May 12, 2015

(54) SLEEVES ACCESSORY

(71) Applicant: Karen Seiler, Mansfield, TX (US)

(72) Inventor: Karen Seiler, Mansfield, TX (US)

( * ) Notice: Subject to any disclaimer, the term of this patent is extended or adjusted under 35 U.S.C. 154(b) by 0 days.

(21) Appl. No.: 14/212,314

(22) Filed: Mar. 14, 2014

(65) Prior Publication Data

US 2014/0273736 A1 Sep. 18, 2014

Related U.S. Application Data

(60) Provisional application No. 61/851,946, filed on Mar. 14, 2013.

(51) Int. Cl.

| | |
|---|---|
| ***A41D 1/22*** | (2006.01) |
| ***A41D 15/00*** | (2006.01) |
| *A41D 13/08* | (2006.01) |
| *A41D 27/10* | (2006.01) |

(52) U.S. Cl.

CPC . *A41D 1/22* (2013.01); *A41D 27/10* (2013.01); *A41D 15/007* (2013.01)

(58) Field of Classification Search

CPC ..... A41D 27/12; A41D 27/13; A41D 27/136; A41D 13/08; A41D 13/10; A41D 13/0017; A41D 15/007; A41D 1/22

USPC ..... 450/1; 2/16, 46, 50–52, 54–56, 58, 59, 2/69, 102, 106, 109, 110, 113–115, 125, 2/126, 122

See application file for complete search history.

(56) References Cited

U.S. PATENT DOCUMENTS

| | | | | | |
|---|---|---|---|---|---|
| 817,961 | A * | 4/1906 | Davis | 2/55 |
| 1,117,077 | A * | 11/1914 | Morney | 2/16 |
| 1,157,341 | A * | 10/1915 | Tallerday | 2/91 |
| 1,285,917 | A * | 11/1918 | Bradley | 2/91 |
| 1,751,872 | A * | 3/1930 | Medaugh | 2/159 |
| 1,796,782 | A * | 3/1931 | Gasperini | 2/87 |
| 2,045,157 | A * | 6/1936 | Robert | 2/16 |
| 2,150,069 | A * | 3/1939 | Koleno | 2/59 |
| 3,421,514 | A * | 1/1969 | Friedlander | 450/30 |
| 4,356,570 | A * | 11/1982 | Vernon et al. | 2/16 |
| 4,625,338 | A * | 12/1986 | Starling | 2/106 |
| 4,985,934 | A * | 1/1991 | Perry | 2/125 |
| 5,023,953 | A * | 6/1991 | Bettcher | 2/126 |
| 5,245,707 | A * | 9/1993 | Green | 2/54 |
| 5,357,633 | A * | 10/1994 | Rael | 2/16 |
| 5,909,801 | A * | 6/1999 | Coffman | 2/16 |
| 7,066,784 | B2 * | 6/2006 | Peay | 450/31 |
| 7,429,206 | B2 * | 9/2008 | Perry | 450/86 |
| 8,650,662 | B2 * | 2/2014 | Decker | 2/16 |
| 8,667,613 | B2 * | 3/2014 | Blakely et al. | 2/16 |
| 2006/0089081 | A1 * | 4/2006 | Peay | 450/1 |
| 2007/0163026 | A1 * | 7/2007 | Perry | 2/69 |
| 2013/0185845 | A1 * | 7/2013 | Decker | 2/243.1 |

* cited by examiner

*Primary Examiner* — Gloria Hale
(74) *Attorney, Agent, or Firm* — Thrasher Associates

(57) ABSTRACT

The invention provides sleeves for wearing with sleeveless shirts and tops.

8 Claims, 3 Drawing Sheets

SLEEVES ACCESSORY

CLAIM OF PRIORITY

The invention relates to and claims priority from U.S. Provisional Patent Application No. 61/851,946 to Karen Seiler entitled SLEEVES ACCESSORY and filed on Mar. 14, 2013.

FIELD OF INVENTION

The invention relates generally to garments, and more specifically a garment accessory.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

Many workplaces and travel destinations, such as cathedrals, require arms to be covered. This can be frustrating when one has a favorite top/shirt that one wishes to wear when working or traveling. Additionally, sometimes it is socially prudent to cover tattoos, scars, skin conditions, or other unusual marks on one's arms. The present invention solves these problems.

BRIEF DESCRIPTION OF THE DRAWINGS AND TABLES

Various aspects of the invention, as well as an embodiment, are better understood by reference to the following detailed description. To better understand the invention, the detailed description should be read in conjunction with the drawings and tables, in which:

FIG. 1 is a back-view of the accessory being worn;

FIG. 2 is front-view of the accessory being worn; and

FIG. 3 is a close-up side-view of the accessory being worn.

EXEMPLARY EMBODIMENT OF A BEST MODE

Interpretation Considerations

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for-functioning-" or "step for-functioning-" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

As will be understood by those of ordinary skill in the art, various structures and devices are depicted in block diagram form in order to avoid unnecessarily obscuring the invention. It should be noted in the following discussion that acts with like names are performed in like manners, unless otherwise stated.

Of course, the foregoing discussions and definitions are provided for clarification purposes and are not limiting. Words and phrases are to be given their ordinary plain meaning unless indicated otherwise.

DESCRIPTION OF THE DRAWINGS

The invention is preferably embodied as a one-piece garment that is put on one arm at a time (similar to a jacket). In a preferred embodiment and discussed in more detail below, the Sleeves have 4 #3 hooks strategically placed on them to "hook" onto a woman's bra at the top of the strap by the cup and under the arm to keep it in place. The inventive sleeves come in various material patterns from leopard, stretchy lace, and flat matt, for example. The invention preferably comprises stretchy fabrics that have spandex in them. The preferred material that is used for the sleeves provides 50+ blocks 99-100% of all Ultra Violet Rays.

The Description of the Drawings is made with simultaneous reference to FIGS. 1-3, in which.

Figure 1:
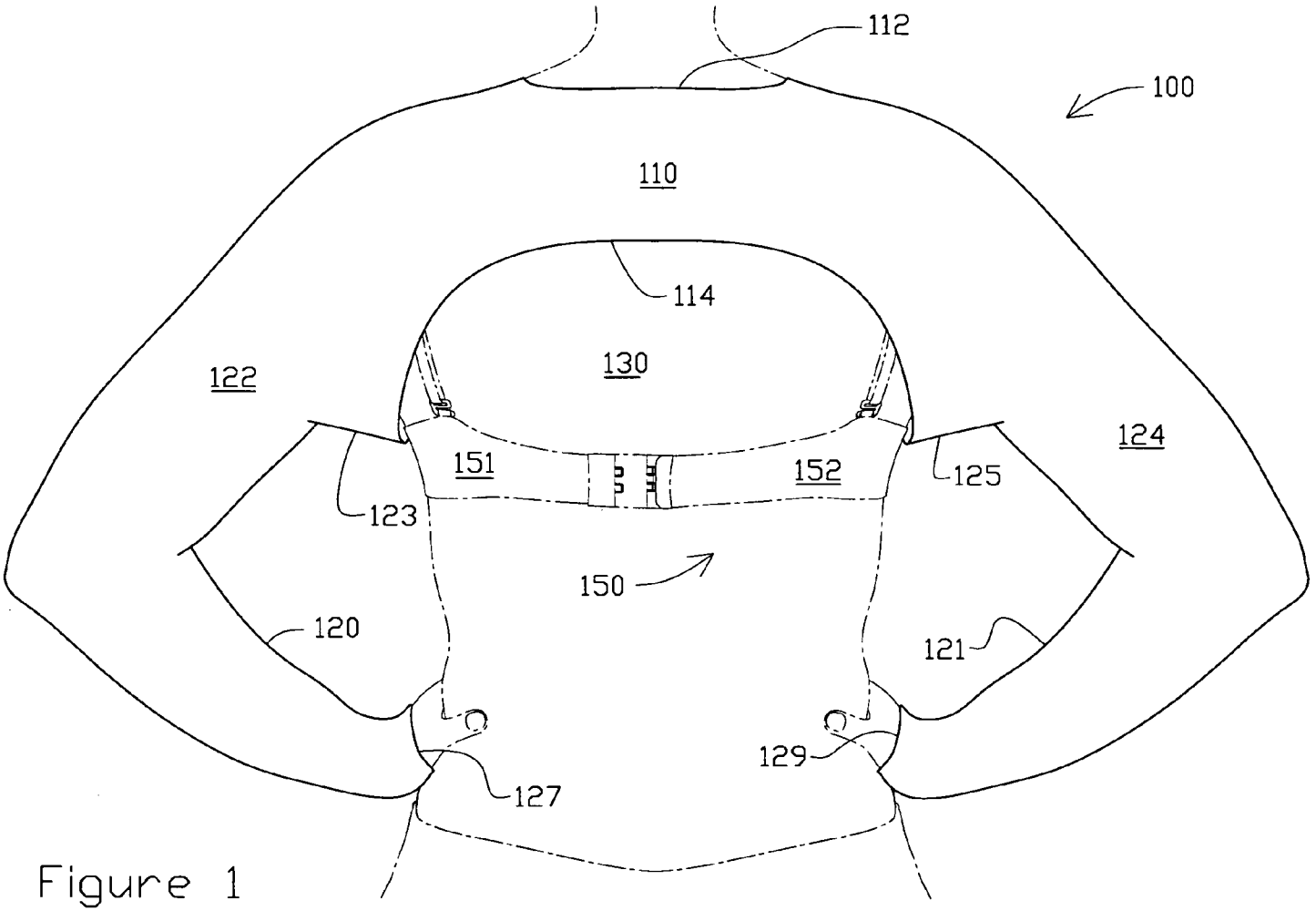
FIG. 1 is a back-view of the accessory being worn.
Figure 2:
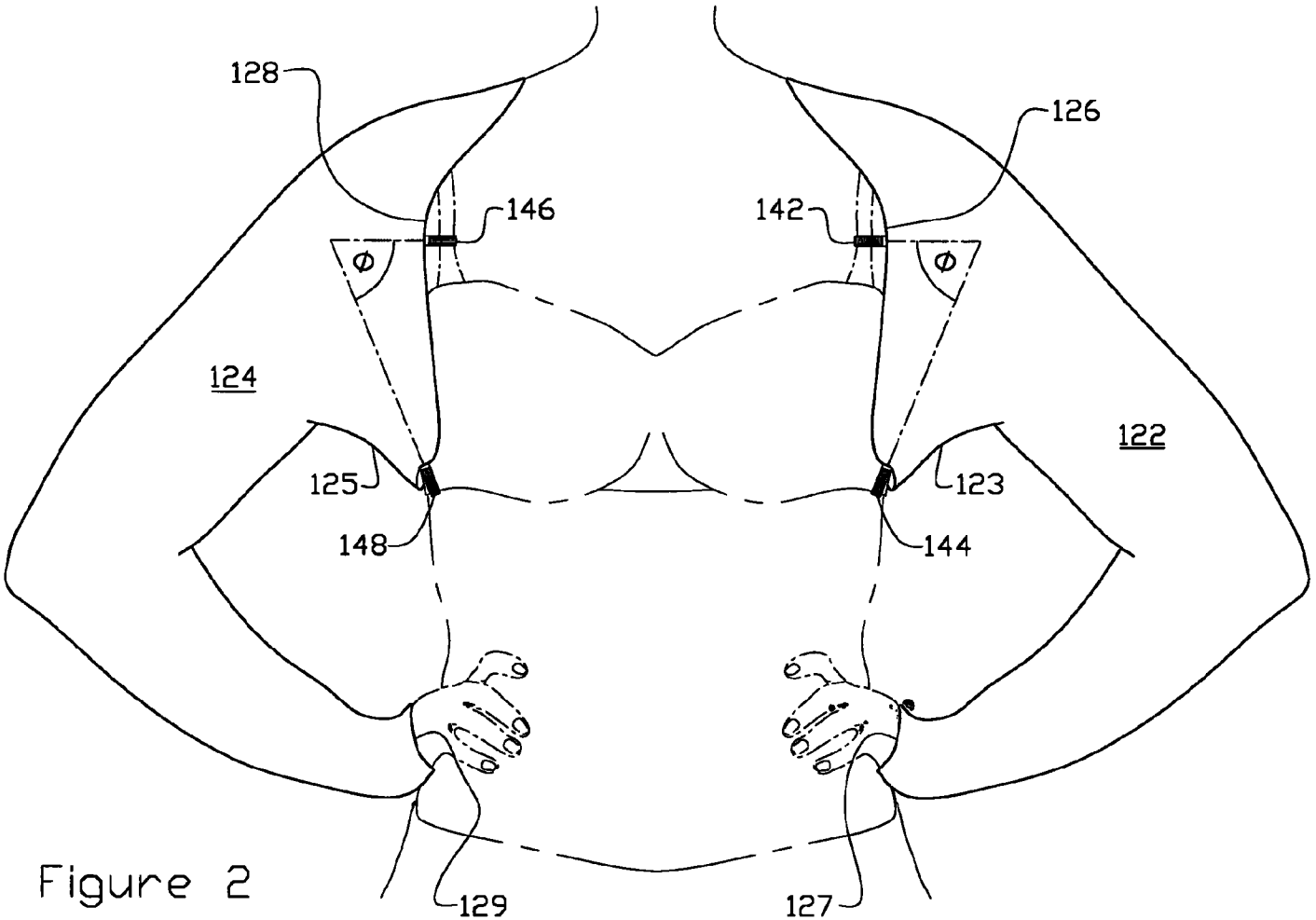
FIG. 2 is front-view of the accessory being worn.

The inventive garment accessory 100 is preferably comprised of a left long-sleeve 122 terminating in a first cuff 127 and a generally round first arm hole 126 opposite the first cuff 127, a right long-sleeve 124 terminating in a second cuff 129 and a generally round second arm hole 128 opposite the second cuff 127, where the left long-sleeve 122 is coupled to the right long-sleeve 124 via a fabric yoke 110 having an open neck portion 112. The fabric is preferably chosen from a stretch fabric, such as nylon, spandex, vinyl, or as is preferred, neoprene, for example.

The left long-sleeve 122 has a first seam 120 along a bottom portion of the left long-sleeve 122, the first seam 120 runs from the first cuff 127 to the first arm hole 126. Similarly, the right long-sleeve 124 has a second seam 121 along a bottom portion of the right long-sleeve 124, the second seam 121 runs from the second cuff 129 to the second arm hole 128.

The accessory 100 couples to a bra 150 via a plurality of attachments. The first arm hole 126 has a first bra attachment (such as a hook or snap, for example) 144 proximate to an intersection of the first seam 120 and the first arm hole 126; similarly, the second arm hole 128 has a second bra attachment 148 proximate to an intersection of the second seam 121 and the second arm hole 128. A little higher, the first arm hole 126 has a first bra strap hook 142 located opposite the yoke 110, and separated apart from the first bra hook 144 by between 75-degrees and 105-degrees, which attaches to a first bra strap 154; and, similarly, the second arm hole 128 has a second bra strap hook 146 located opposite the yoke 110, and separated apart from the second bra hook 148 by between 75-degrees and 105-degrees.

Figure 3:
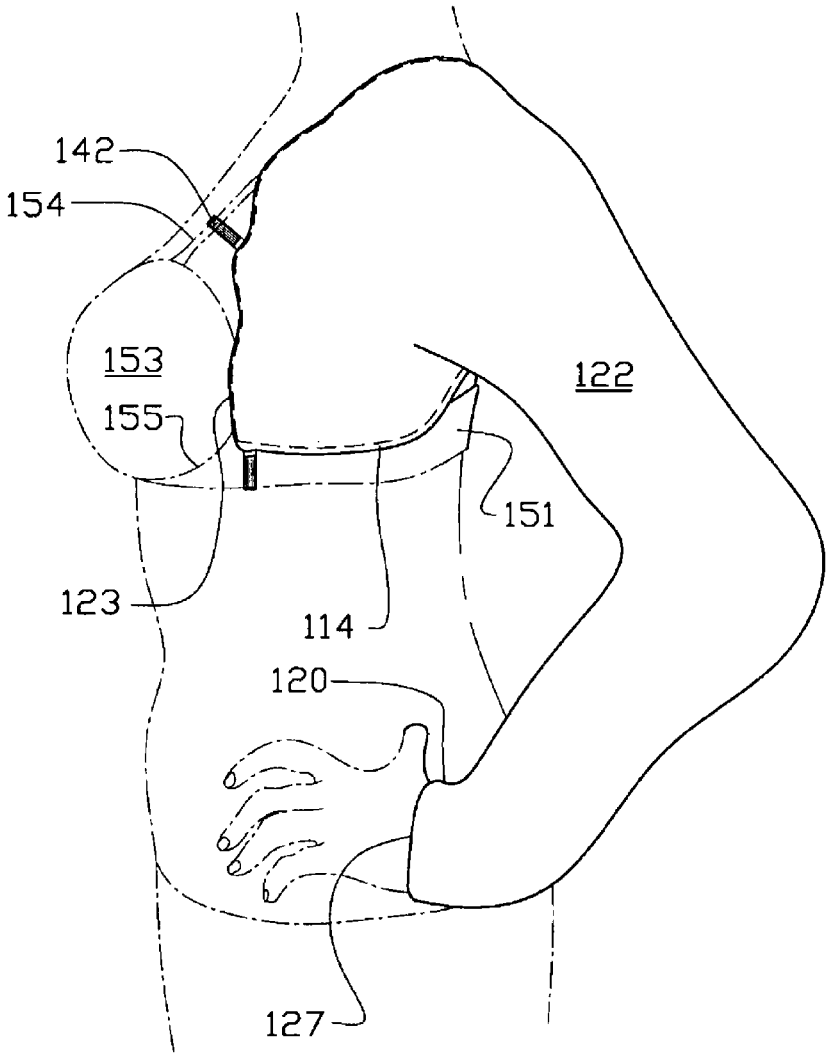
FIG. 3 is a close-up side-view of the accessory being worn.

Accordingly, when worn about a torso 130, the accessory 100 stretches to create a first torso-forming portion 123 that wraps about a left bra wing 151, and a second torso-forming portion 125 that wraps about a right bra wing 152. Shown specifically in FIG. 3, is the hem 114 of the yoke 110 forming across a back of the torso 130. Also shown in FIG. 3 is a left-cup 153 and the left-cup wing seam 155. As is readily understood by those in the garment arts, the bra 150 preferably has a channel and underwire in each bra cup, and, alternatively an under band can be set into a bra frame. An underwire and/or under band can help anchor bra attachments 144, 148.

The inventive sleeve accessory comes in varieties of fabric patterns from stripes to leopard to lace. Although not shown, thumb-holes or finger loops are optionally provided to take the sleeves from day to night. Various attachments that couple the accessory to a bra, such as snaps and hooks and equivalents, can be incorporated by the sleeves; and, the preferred embodiment incorporates hooks (for example, as shown in the Figures). While they can be made of any fabric, it is preferred that they be made of a thin, shape-keeping material (such as spandex) to hide their appearance under other clothing. Neoprene and Dry fit material are used for sports. Also they are made in a variety of sleeve lengths, including a ¾ length option.

Thus, though the invention has been described with respect to a specific preferred embodiment, many advantages, variations and modifications will become apparent to those skilled in the art upon reading the present application. It is therefore the intention that the appended claims and their functional equivalents be interpreted as broadly as possible in view of the prior art to include all such variations and modifications.

What is claimed is:

1. A garment accessory, comprising:

a left long-sleeve terminating in a first cuff, and a generally round first arm hole opposite the first cuff;

a right long-sleeve terminating in a second cuff, and a generally round second arm hole opposite the second cuff;

the left long-sleeve coupled to the right long-sleeve via a fabric yoke;

the left long-sleeve having a first seam along a bottom portion of the left long-sleeve, the first seam running from the first cuff to the first arm hole;

the right long-sleeve having a second seam along a bottom portion of the right long-sleeve, the second seam running from the second cuff to the second arm hole;

the first arm hole having a first bra attachment proximate to an intersection of the first seam and the first arm hole;

the second arm hole having a second bra attachment proximate to an intersection of the second seam and the second arm hole;

the first arm hole having a first bra strap attachment located opposite the yoke, and separated apart from the first bra attachment by a first angle ø being between 75-degrees and 105-degrees; and the second arm hole having a second bra strap attachment located opposite the yoke, and separated apart from the second bra attachment by a second angle ø being between 75-degrees and 105-degrees.

2. The garment accessory of claim 1 wherein the left-long sleeve, the yoke, and the right long-sleeve are formed from a single piece of fabric.

3. The garment accessory of claim 1 wherein the fabric is nylon.

4. The garment accessory of claim 1 wherein the fabric is neoprene.

5. The garment accessory of claim 1 wherein the fabric is spandex.

6. The garment accessory of claim 1 wherein the fabric is vinyl.

7. The garment accessory of claim 1 wherein the first bra strap attachment is a hook.

8. A garment accessory, comprising:

a left long-sleeve terminating in a first cuff, and a generally round first arm hole opposite the first cuff;

a right long-sleeve terminating in a second cuff, and a generally round second arm hole opposite the second cuff;

the left long-sleeve coupled to the right long-sleeve via a neoprene yoke;

the left long-sleeve having a first seam along a bottom portion of the left long-sleeve, the first seam running from the first cuff to the first arm hole;

the right long-sleeve having a second seam along a bottom portion of the right long-sleeve, the second seam running from the second cuff to the second arm hole;

the first arm hole having a first bra hook proximate to an intersection of the first seam and the first arm hole;

the second arm hole having a second bra hook proximate to an intersection of the second seam and the second arm hole;

the first arm hole having a first bra strap hook located opposite the yoke, and separated apart from the first bra hook by a first angle ø being between 75-degrees and 105-degrees; and the second arm hole having a second bra strap hook located opposite the yoke, and separated apart from the second bra hook by a second angle ø being between 75-degrees and 105-degrees.

* * * * *